US006817462B1

(12) United States Patent
Salda

(10) Patent No.: US 6,817,462 B1
(45) Date of Patent: Nov. 16, 2004

(54) RECYCLING DEVICE

(75) Inventor: Luciano Salda, Vignola (IT)

(73) Assignee: C.M.S. S.P.A., Marano S/P (IT)

( * ) Notice: Subject to any disclaimer, the term of this patent is extended or adjusted under 35 U.S.C. 154(b) by 137 days.

(21) Appl. No.: 10/031,362

(22) PCT Filed: Jul. 19, 2000

(86) PCT No.: PCT/EP00/06903

§ 371 (c)(1),
(2), (4) Date: Apr. 29, 2002

(87) PCT Pub. No.: WO01/06465

PCT Pub. Date: Jan. 25, 2001

(30) Foreign Application Priority Data

Jul. 19, 1999 (DE) ..... 299 12 568 U

(51) Int. Cl.[7] ..... G07F 7/00

(52) U.S. Cl. ..... 194/208; 194/209; 194/210; 194/212; 209/655; 209/698; 209/919; 241/81; 241/99

(58) Field of Search ..... 194/208, 209, 194/210, 212, 213; 209/539, 579, 635, 655, 698, 919, 924, 933; 241/36, 99, 81, 100; 356/42, 72, 73

(56) References Cited

U.S. PATENT DOCUMENTS

| | | | | | |
|---|---|---|---|---|---|
| 4,285,426 | A | | 8/1981 | Cahill | |
| 4,454,028 | A | * | 6/1984 | Vetter et al. | 209/548 |
| 4,459,487 | A | | 7/1984 | Leser | |
| 4,519,307 | A | | 5/1985 | La Barge et al. | |
| 4,597,487 | A | * | 7/1986 | Crosby et al. | 194/209 |
| 4,653,627 | A | * | 3/1987 | Hampson et al. | 194/209 |
| 4,784,251 | A | | 11/1988 | DeWoolfson et al. | |
| 4,915,205 | A | * | 4/1990 | Reid et al. | 194/205 |
| 4,949,834 | A | * | 8/1990 | Schindel | 198/392 |
| 5,152,387 | A | * | 10/1992 | Hammond | 194/208 |
| 5,248,102 | A | | 9/1993 | Bohn | |
| 5,423,492 | A | * | 6/1995 | Willis | 241/81 |
| 5,435,445 | A | * | 7/1995 | Dellinger et al. | 209/576 |
| 5,934,440 | A | * | 8/1999 | Kroghrud | 194/212 |
| 6,012,588 | A | * | 1/2000 | Steidel et al. | 209/523 |
| 6,112,904 | A | * | 9/2000 | Ajo | 209/523 |
| 6,186,308 | B1 | * | 2/2001 | Coyne et al. | 194/209 |
| 6,547,055 | B2 | * | 4/2003 | Coyne et al. | 194/207 |

FOREIGN PATENT DOCUMENTS

| | | |
|---|---|---|
| DE | 4418174 A1 | 11/1995 |
| EP | 0718811 A1 | 6/1996 |
| EP | 0766188 A1 | 4/1997 |
| EP | 0774330 A1 | 5/1997 |

* cited by examiner

*Primary Examiner*—Donald P. Walsh
*Assistant Examiner*—Jeffrey A. Shapiro
(74) *Attorney, Agent, or Firm*—Burns, Doane, Swecker & Mathis, L.L.P.

(57) ABSTRACT

A return device for containers, such as bottles, cups, cans, or the like, comprises an insertion opening for receiving the container and at least one distributing means for transporting the container from the insertion opening to a selectable processing means of the return device.

For a faster and easier sorting of the containers in a compact way, the distributing means comprises at least one intermediate bottom and a receiving means which is movable relative to the bottom, transports the container away from the insertion opening and is provided with a bottom opening, the intermediate bottom being movably supported in the return device and comprising at least one sorting opening which can be positioned below the bottom opening for passing the container therethrough to the selected processing means.

19 Claims, 4 Drawing Sheets

RECYCLING DEVICE

The present invention relates to a return device for containers, such as bottles, cups, cans, or the like, comprising a insertion opening for receiving the container and at least one distributing means for transporting the container from the insertion opening to a selectable processing means of the return device.

Such return devices are e.g. described in EP 0 774 330 and US-A4784251. Used containers can be put into the return device via the insertion opening. The containers may be bottles of glass or plastics, plastic cups, plastic containers, aluminum cans, or the like. The containers can be processed, collected, stacked, crushed, compacted, washed or also supplied to a garbage collecting container for recycling purposes by means of the return device and corresponding processing means arranged therein.

As a rule, a user of the return device receives a coupon or a direct payment for the returned container to make its return more attractive to the user. The known return devices can be used for different containers, such as differently colored glass bottles, different types of plastics, or the like. Depending on the color of the glass or the type of plastics, the container is distributed to a corresponding receiving means. Such a processing means may e.g. be a cup stacking means, a collecting station, a crushing and/or compacting station, or the like.

It is the object of the present invention to improve a return device of the above-mentioned type such that the containers can be sorted faster and more easily in a compact way.

The object is achieved in that the distributing means comprises at least one intermediate bottom and a receiving means which is movable relative to said bottom, transports the container away from the insertion opening is provided with a bottom opening, the intermediate bottom being movably supported in the return device and comprising at least one sorting opening which can be positioned below the bottom opening for passing the container therethrough to the selected processing means.

An assignment to the selected processing means can directly be made in this way by the receiving means, and after arrangement of the sorting opening below the bottom opening of the receiving means the container is moved to the selected processing means or falls automatically through the superposed openings towards the processing means. The processing means is therefore assigned by simply adjusting receiving means and intermediate bottom.

If the processing means or corresponding feed lines to said means are arranged along a straight line, the receiving means can be moved along said straight line within the return device. If the container is arranged on the intermediate bottom above the selected processing means, it is possible by subsequent displacement of the intermediate bottom extending e.g. along the direction of movement of the receiving means to arrange the sorting opening disposed in said intermediate bottom between bottom opening of the receiving means and processing means. The container will then fall through the superposed openings towards the processing means.

To simplify the assignments of the containers relative to the corresponding processing means, a support plate can be arranged within the return device; the support plate has a number of passage holes each assigned to at least one processing means and the intermediate bottom is movable relative to said support plate for arranging the sorting opening between bottom opening and selected passage hole.

The processing means can be connected to the corresponding passage holes in a way which is known per se.

For inserting the container through the insertion opening directly into the receiving means in a simple way, the receiving means may comprise a shell which can be assigned with its open side to the insertion opening. The shell is opposite to the insertion opening in the case of a corresponding assignment, so that the container can directly be inserted by a user into the shell. After the insertion opening has been closed manually or automatically, the shell is then positioned with the container above the corresponding processing means or above the passage hole assigned thereto and the container will fall towards the selected processing means after displacement of the sorting opening down to and below the bottom opening.

To obtain a compact return device of a particularly simple construction, it is possible that the intermediate bottom is circular and rotatable about its center axis. The sorting opening may here be arranged at a corresponding place within the circular intermediate bottom.

The sorting opening is of a simple design if the opening is designed as a radially outwardly open peripheral recess of the intermediate bottom.

To give the receiving means a simple and inexpensive design as well, the shell can be rotatably supported coaxially relative to the center axis of the intermediate bottom. It is in this way that the shell is first rotated into the corresponding position, and after a subsequent rotation of the intermediate bottom and arrangement of the sorting opening below the bottom opening of the shell the container will fall through the corresponding passage hole of the support plate towards the processing means.

An advantageous embodiment of the invention is possible, wherein a bearing shaft projects substantially in vertical direction from the support plate and has rotatably supported thereon the shell and/or intermediate bottom. A separate support of shell and intermediate bottom within the return device can thereby be dispensed with because these are directly supported on the support plate.

The bearing shaft may be designed as a rod-like shaft or as a hollow shaft.

A simple arrangement of the passage holes is possible, wherein said holes are arranged along a circle in concentric fashion relative to the intermediate bottom. Each passage hole can thereby be reached by corresponding rotation of the intermediate bottom and the shell, respectively, and shell, passage hole and sorting opening are here arranged with a corresponding radial distance relative to the center axis or bearing shaft.

The container can e.g. freely fall from a passage hole into a collecting container. Likewise, it is possible to supply the container in a selective way to the processing means, for example via guides. Advantageously, a guide can extend from each passage hole to the corresponding processing means. The guides may be designed in the manner of a chute or pipe or in another way that is known per se. Likewise, it is possible to transport the container by the guide (see e.g. EP 0 718 811), wherein the containers are transported along a circular path from a receiving point to a washing means and then to a discharge point.

To sort the containers as much as possible, at least one identifying means may be assigned to the insertion opening and/or the receiving means and/or the support plate and/or the intermediate bottom for identifying at least one characteristic feature of the container. Such a characteristic feature is e.g. material, color, size, weight, or the like. Such an identifying means may be constituted by a camera, a bar code reader, see EP 0 766 188, a light barrier, optical-fibers, or the like. On the basis of the result of identification, glass containers, for example, can be sorted and processed in accordance with their color. Likewise, the type of plastic material can be detected, for example by means of a bar code printed on the container, and the container can be transported to the appropriate processing means.

In particular, in order to be able to sort the containers according to their shape, the characteristic feature recognized by the identifying means may have the geometrical shape of the container.

To be able to classify the containers in a simple way as to different profiles or geometrical shapes, a storage and/or evaluation means may be assigned to the identifying means, in particular for storing different geometrical shapes of the containers and for comparing a container to be recognized with a stored shape. For instance, a profile that has already been stored is compared with the container to be recognized and the geometrical shape of the inserted container is recognized through a corresponding algorithm.

To be able to check the inserted container in a simple way with the identifying means and also to be able to input various geometrical shapes for storage in the storage means, the identifying means may be designed as a scanning means and may be movable relative to the container to be scanned. This means that the identifying means also serves to store a corresponding profile or a corresponding geometrical shape and, later, to actually check an inserted container and to transmit the corresponding profile or shape data to the storage and/or evaluation means. Examples of such an identifying means are ultrasonic or laser beam sensors which move towards a fixed container, a fixed sensor relative to which the container moves, or the like. It is also possible that a simultaneous movement of sensor and container takes place for identification.

In particular in the evaluation unit, a comparison is then made between received profile or shape or stored profile or shape via an appropriate algorithm.

A simple support for the intermediate bottom may be that said bottom comprises a central rotational sleeve which is rotatably attached to the bearing shaft of the support plate.

By analogy, the shell can be held by means of a radial arm by a bearing sleeve which is rotatably attached to the rotational sleeve.

If the bearing shaft of the support plate is formed by a hollow shaft, it is possible that the rotational sleeve of the intermediate bottom is rotatably supported in the hollow shaft of the support plate and that a bearing shaft of the receiving means is rotatably supported in the rotational sleeve. The shell can again be held by said bearing shaft by means of a radial arm.

A simple and exact automatic control for the return device may be obtained in that the shell of the receiving means and of the intermediate bottom are rotatable in accordance with signals of the identifying means. The return device may possess corresponding means for signal processing and for controlling the movements, such as for example a microprocessor, or the like. Moreover, it is possible to input the type of container from the outside on the return device, so that a control is carried out within the return device in accordance with said input signals.

The intermediate bottom may also be sector-shaped for reasons of costs and for saving material.

Advantageous embodiments of the invention shall now be explained in more detail with reference to the figures as attached in the drawing, of which:

Figure 1:
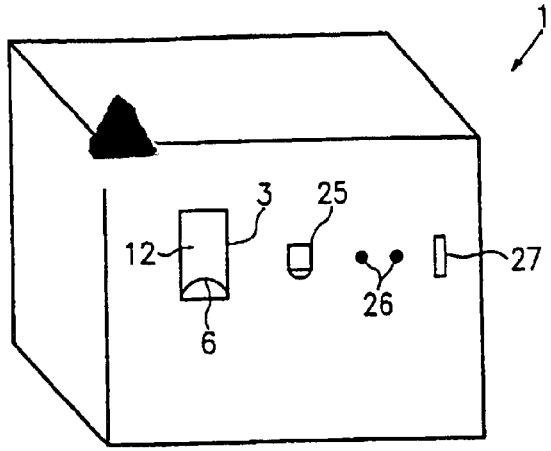
FIG. 1 is a perspective basic view of a return device.

FIG. 1 is a perspective front view of a return device 1. Said device is provided on its front side with a insertion opening 3 for inserting containers 2; see FIG. 2. The insertion opening has arranged therein a shell 12 with a bottom opening 6 into which a corresponding container can be put.

At the side next to the insertion opening 3, there are e.g. arranged a money dispenser 25, control lights or setting means, and a receipt dispenser 27. The money dispenser 25 serves to dispense a specific amount of money per inserted container. The control lights or setting means 26 serve to display the function or to select the function of the return device 1. Instead of an amount of money via the money dispenser 25, it is also possible to take out a receipt via receipt dispenser 27.

Figure 2:
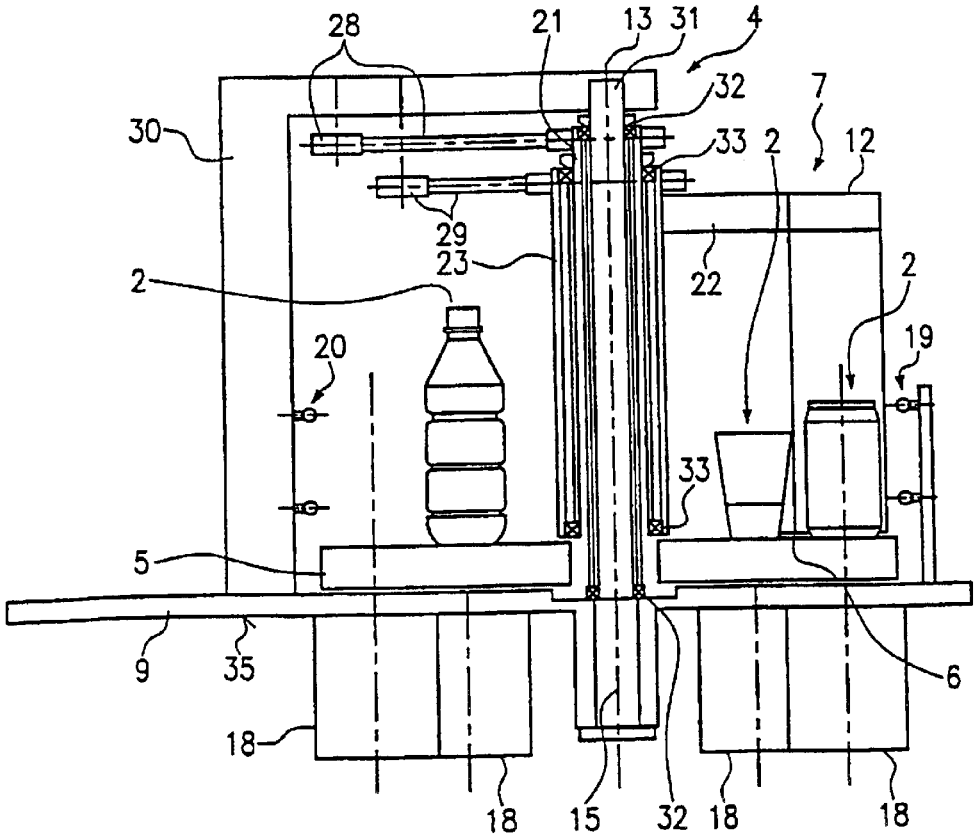
FIG. 2 is a side view of a distributing means within the return device according to FIG. 1 in accordance with the first embodiment of the invention.

FIG. 2 illustrates a first embodiment of a distributing means 4 which is arranged within the return device 1 according to FIG. 1. Identical reference numerals identify identical parts in this figure and in the following ones and might only be mentioned with reference to one figure.

The distributing means 4 comprises a planar support plate 9 which is fixedly arranged within the return device 1. A bearing shaft 15 projects from the support plate 9 substantially in vertical direction. A receiving means 7 and an intermediate bottom 5 are rotatably supported about said shaft.

A bottom side 35 of the support plate 9 has arranged thereon a number of guides 18 which extend to processing means (not shown). Such processing means are known per se and may e.g. be a washing station, a compacting station, a crushing station, a stacking station, a collecting station, a garbage collecting sack, or the like.

At an upper side of the support plate 9 which is opposite to the bottom side 35, a circular intermediate bottom is rotatably supported about its center axis 13. For supporting purposes the intermediate bottom 5 comprises a rotational sleeve 21 in concentric fashion relative to the center axis 13, said sleeve being rotatably supported at the upper and lower end by means of rotational bearings 32 at an outer side of the bearing shaft 15. At the upper end, the rotational sleeve 21 is connected via a drive train 28, for instance in the form of gears or the like, to a drive means (not shown).

Different containers 2, such as a plastic bottle, a plastic cup and an aluminum can, are put on the intermediate bottom 5. Said containers can be placed via the insertion opening 3 of the return device 1 (see FIG. 1) on the intermediate bottom 5.

The receiving means 7 is arranged above the intermediate bottom 5. Said receiving means comprises a shell 12 which is open at one side. In FIG. 1, the shell 12 is assigned to the insertion opening 3, and a corresponding container 2 can be inserted into the shell.

Figure 3:
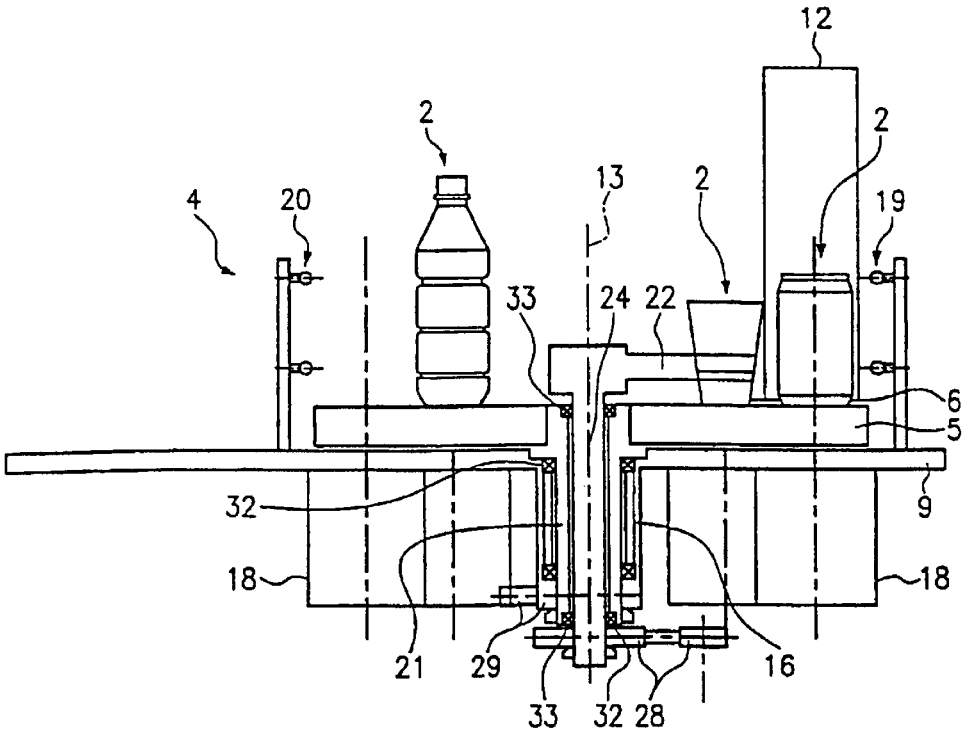
FIG. 3 is a side view corresponding to FIG. 2 for a second embodiment of the invention.

At its lower end, the shell 12 comprises a bottom opening 6 through which the container 2, see FIG. 2 or 3, is placed on the upper side of the intermediate bottom 5. At its end opposite to the bottom opening 6, the shell 12 is connected via a radial arm 22 to a bearing sleeve 23. Said bearing sleeve is attached in concentric fashion relative to the rotational sleeve 21 to said rotational sleeve and rotatable relative to the rotational sleeve 21 by means of rotational bearing 33. At its upper end, the bearing sleeve 23 is connected via a drive train 29, e.g. in the form of gears or the like, to a drive means (not shown).

For retaining the bearing shaft 15 at its upper end 31, a substantially L-shaped bearing arm 30 projects from the upper side of the support plate 9, the bearing arm 30 comprising a vertical and a horizontal leg. The upper end 31 of the bearing shaft 15 is held at the free end of the horizontal leg.

The support plate 9 and the vertical leg of the bearing arm 30, respectively, have arranged thereon identifying means 19, 20 by which specific characteristic features of the containers 2 can be detected. Such characteristic features are e.g. size, weight, color, material quality, or the like. Moreover, a bar code can be read on a container 2 by such an identifying means 19, 20, and the corresponding information can be evaluated.

In FIG. 3, a second embodiment of the distributing means 4 is shown in a view analogous to FIG. 2. The second embodiment substantially differs from the preceding one by the feature that intermediate bottom 5 and receiving means 7 are driven by the support plate 9 from the bottom side thereof.

The shell 12 is connected next to its bottom opening 6 via the radial arm 22 to a bearing shaft 24 which is rotatably supported at its upper and lower ends by rotational bearings 33 in the rotational sleeve 21 of the intermediate bottom 5. The rotational sleeve 11 extends from the rotational bottom 5 downwards towards the support plate 9 and concentrically into a hollow shaft 16 as a bearing shaft 15 of the support plate 9; see also FIG. 2. Hollow shaft 16, rotational sleeve 11 and bearing shaft 23 extend concentrically relative to the center axis 13, so that the shell 12 moves along a circular path around the center axis 13.

Corresponding identifying means 19 and 20 are arranged on an upper side of the support plate 9.

Figure 4:
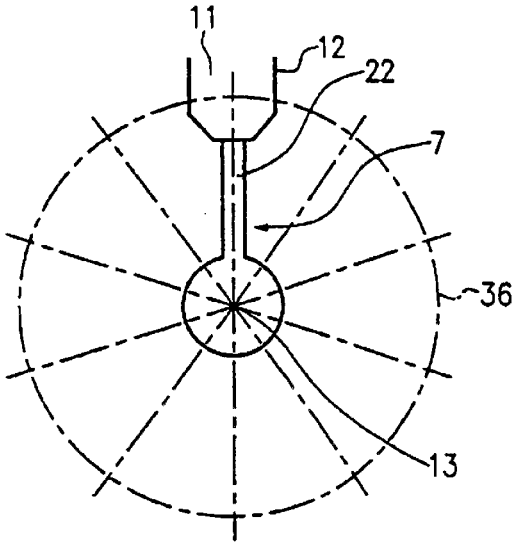
FIG. 4 is a top view on a receiving means as part of the distributing means.

FIG. 4 is a top view on the receiving means 7 according to FIG. 3. The shell 12 moves substantially along a circular path 36 upon rotation about center axis 13. The shell 12 is substantially U-shaped with a radially outwardly oriented open side 11 which according to FIG. 1 can be assigned to the insertion opening 3 in the outside of the return device 1.

Figure 5:
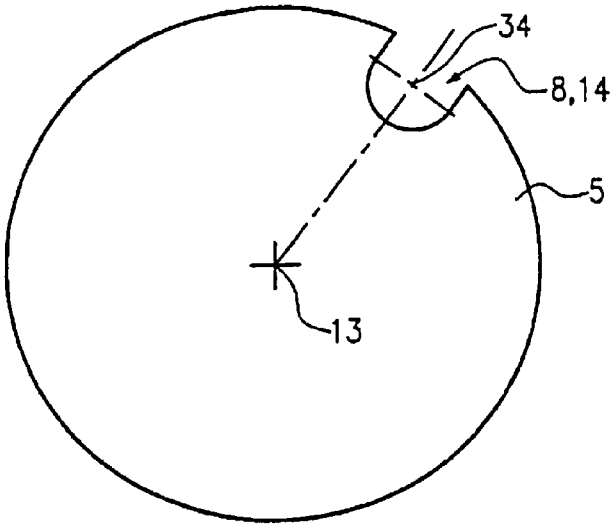
FIG. 5 is a top view on an intermediate bottom as part of the distributing means.
Figure 6:
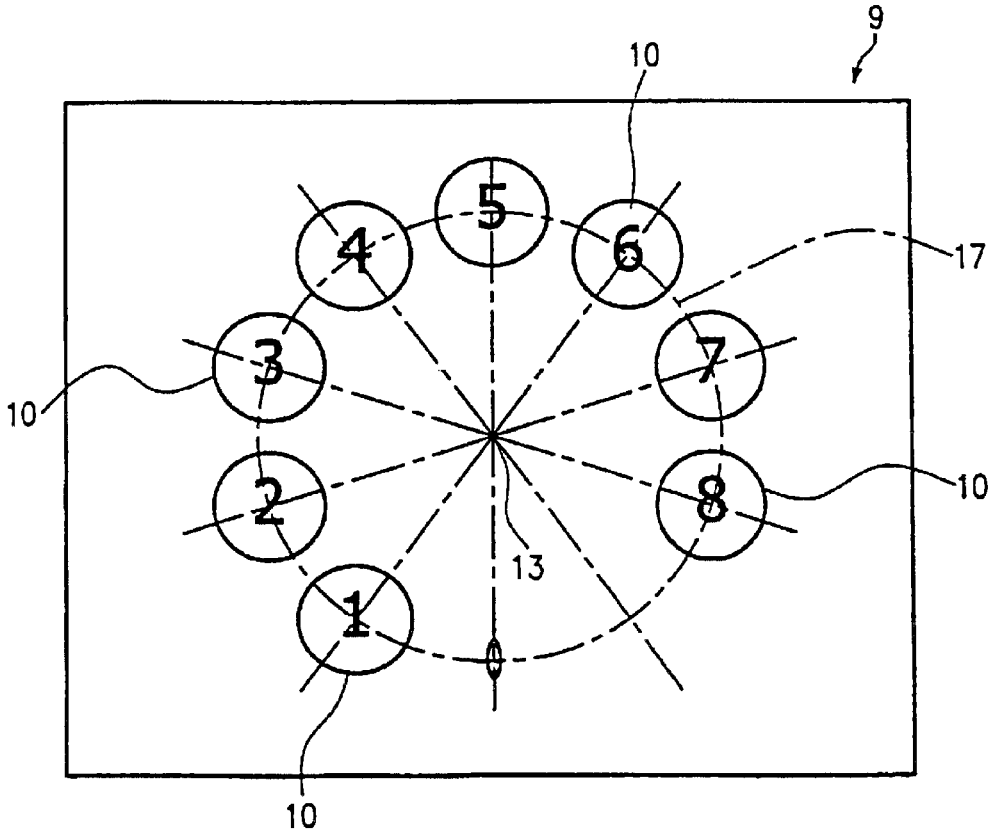
FIG. 6 is a top view on a support plate as part of the distributing means.

FIG. 4 shows in dash-dotted fashion various other positions of the shell 12 in which passage holes 10, see FIG. 6, are assigned to the shell in the support plate 9. FIG. 5 is a top view on the intermediate bottom 5 without a rotational sleeve 21, see FIG. 2 or 3. The intermediate bottom 5 is designed as a circular rotational disc, in particular of plastics, and is provided along its circumference with a sorting opening 8 as a radially outwardly open peripheral recess 14. Said recess is movable about center axis 13 along a circular path 34. Circular path 34 and circular path 36, see FIG. 4, have the same radius so that the sorting opening 8 can be assigned to the bottom opening 6.

FIG. 6 is a top view on the support plate 9 without corresponding drive means or bearing means for the remaining parts of the distributing means 4. A number of passage holes 10 are arranged in the support plate 9 along a circle 17. Circle 17 extends around center axis 13 as the center point and has substantially the same radius as the circular paths 34 and 36; see FIGS. 5 and 4.

The passage holes 10 are consecutively numbered from "1" to "8", the various passage holes communicating with corresponding guides 18; see FIGS. 2 and 3, on the bottom side of the support plate 9. Said guides extend to different processing means (not shown), such as stacking station, collecting station, compacting station, washing station, crushing station, or the like. The position marked by "0" on circle 17 corresponds to the position of the shell 12 in which according to FIG. 1 it is assigned to the insertion opening 3.

The function of the return device 1 according to the invention shall now be described briefly with reference to the figures.

Through insertion opening 3, a user can place a container 2 in the shell 12 of the receiving means 7 in the "0" position according to FIG. 6. Such a container may be a plastic bottle, a plastic cup, a glass bottle, a plastic container, an aluminum can, or the like. The container is characterized by corresponding identifying means within the return device 1, see FIGS. 2 and 3, and a decision is made on the basis of the corresponding signals which processing means is to be fed with the container. In accordance with said decision, the receiving means 7 is rotated until the shell 12 is arranged above the passage hole 10 assigned to the corresponding processing means. Subsequently, the intermediate bottom 5 is rotated such that the sorting opening 8 is arranged between bottom opening 6 of the shell 12 and selected passage hole 10. Thereupon, the container arranged in the shell 12 falls through sorting opening 8 and passage hole 10 towards selected processing means.

Figure 7:
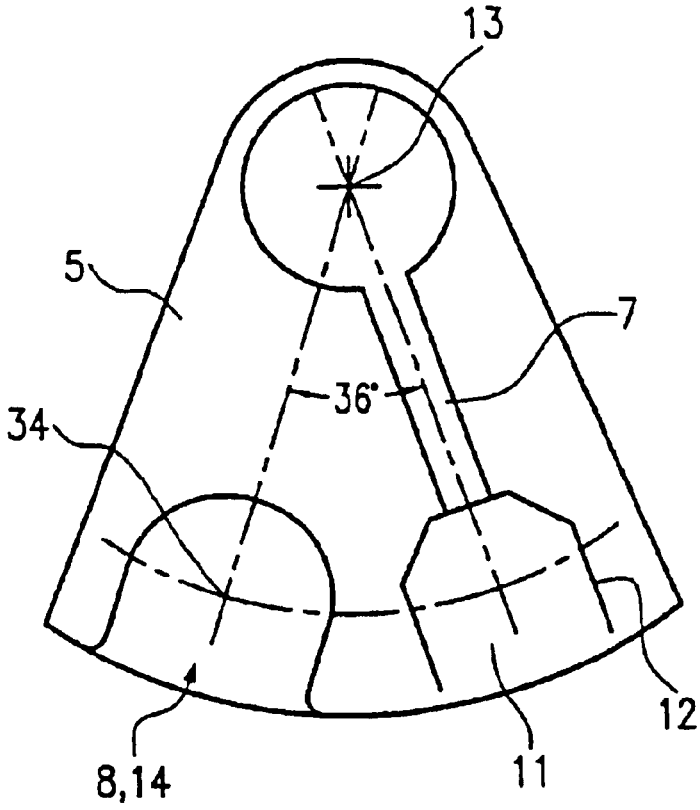
FIG. 7 is a top view on a variant of the invention with a sector-like intermediate bottom.

The embodiment of FIG. 7 uses identical reference numerals for identical parts.

In contrast to the other embodiments in which the intermediate bottom consists of a circular disc, it is designed in sector-like fashion in the embodiment of FIG. 7. It has an angle of less than 50°. In the case of ten imaginary positions or passage holes along a full circle, it extends, for example, over 36°. The receiving means 7 and the sector-like intermediate bottom 5 will rotate simultaneously until the opening of the intermediate bottom is positioned above the corresponding passage hole. The receiving means 7 then rotates by 36° so that the shell 12 is positioned above the sorting opening 8. The remaining process is like in the other embodiments. It should only be noted in passing that the sorting opening may be a circular hole.

What is claimed is:

1. A return device for containers, such as bottles, cups, cans, or the like, comprising: an insertion opening for receiving the container and at least one distributing means for transporting the container from said insertion opening to a selectable processing means of said return device, said distributing means comprising at least one intermediate bottom and a receiving means both rotatably supported about a shaft, wherein said receiving means is rotated to transport the container away from said insertion opening and said intermediate bottom is rotated to position a sorting opening of the intermediate bottom relative to a bottom opening of said receiving means for passing said container through the sorting opening and the bottom opening to a selected processing means.

2. The return device according to claim 1, wherein said return device has arranged therein a support plate which comprises a number of passage holes, each passage hole communicating with at least one processing means, and relative to which said intermediate bottom is movable for arranging said sorting opening between the bottom opening and a selected passage hole.

3. The return device according to claim 1, wherein said receiving means comprises a shell including an open side which can be moved to provide said insertion opening.

4. The return device according to claim 1, wherein said intermediate bottom is circular and rotatable about its center axis.

5. The return device according to claim 1, wherein said sorting opening is designed as a radially outwardly open peripheral recess.

6. The return device according to claim 1, including a shell which is rotatably supported in coaxial fashion relative to said center axis.

7. The return device according to claim 1, wherein a bearing shaft extends substantially in a vertical direction from said support plate and has rotatably supported thereon a shell and/or said intermediate bottom.

8. The return device according to claim 7, wherein said bearing shaft is a hollow shaft.

9. The return device according to claim 1, wherein passage holes are arranged along a circle in concentric fashion relative to said intermediate bottom.

10. The return device according to claim 1, comprising passage holes, wherein a guide extends from each passage hole to a corresponding processing means.

11. The return device according to claim 1, including at least one identifying means arranged with respect to at least one of said insertion opening, said receiving means, said support plate, and said intermediate bottom for identifying at least one characteristic feature of said container.

12. The return device according to claim 11, wherein the characteristic feature of said container is the geometrical shape thereof.

13. The return device according to claim 11, wherein a storage and/or evaluation means is connected to said identifying means for storing different geometrical shapes of said container and for comparing a container to be recognized with a stored shape.

14. The return device according to claim 11, wherein said identifying means is designed as a scanning means and is movable relative to a container to be scanned.

15. The return device according to claim 1, wherein said intermediate bottom comprises a rotational sleeve which is rotatably attached to a bearing shaft of said support plate.

16. The return device according to claim 1, wherein a shell is connected to a bearing sleeve by a radial arm which is rotatably attached to a rotational sleeve.

17. The return device according to claim 1, wherein a rotational sleeve of said intermediate bottom is rotatably supported in a hollow shaft of said support plate and a bearing shaft of said receiving means is rotatably supported in said rotational sleeve.

18. The return device according to claim 1, wherein a shell of said receiving means and said intermediate bottom are rotatable according to signals of identifying means for identifying at least one characteristic feature of said container.

19. The return device according to claim 1, wherein said intermediate bottom is sector-like.

* * * * *